US005423132A

United States Patent [19]

Graber

[11] Patent Number: 5,423,132

[45] Date of Patent: Jun. 13, 1995

[54] DRYER APPARATUS USING HOT GASES IN FREE STANDING VORTEX

[76] Inventor: David A. Graber, 325 Coast Guard Hill, Port Orford, Oreg. 97465

[21] Appl. No.: 954,546

[22] Filed: Sep. 30, 1992

[51] Int. Cl.[6] ..... F26B 3/10

[52] U.S. Cl. ..... 34/487; 34/594

[58] Field of Search ..... 34/57 E, 10, 57 A, 57 R, 34/218, 22, 34

[56] References Cited

U.S. PATENT DOCUMENTS

| | | | |
|---|---|---|---|
| 3,474,970 | 10/1969 | Simmons et al. . | |
| 3,630,024 | 12/1971 | Hopkins . | |
| 3,885,931 | 5/1975 | Schaller . | |
| 4,216,908 | 8/1980 | Sakurai et al. . | |
| 4,421,273 | 12/1983 | Löström . | |
| 4,546,923 | 10/1985 | Ii . | |
| 4,591,324 | 5/1986 | Kubota | 34/57 E X |
| 4,809,442 | 3/1989 | Iwaya et al. | 34/10 |

FOREIGN PATENT DOCUMENTS

| | | | |
|---|---|---|---|
| 2747678 | 5/1978 | Germany . | |
| 2810682 | 9/1978 | Germany . | |
| 488312 | 12/1953 | Italy . | |
| 47-46122 | 4/1963 | Japan . | |
| 122722 | 9/1948 | Sweden . | |
| 484602 | 5/1938 | United Kingdom . | |
| WO88/0495 | 6/1988 | WIPO | 34/34 |

*Primary Examiner*—Henry A. Bennet

*Attorney, Agent, or Firm*—Townsend and Townsend Khourie and Crew

[57] ABSTRACT

An industrial dryer for drying industrial materials, such as sludge, salt water, brines and the like. A transition plate which is slotted in a manner to cause hot gases flowing toward and through the slots to be immediately transformed into a free standing vortex on the downstream side of the transition plate. The vortex operates on the wet materials and the hot gases. Structure is provided to collect the water vapor created by the drying action. In a first embodiment, hot gases are created by the operation of a blower which directs air under pressure through a heater, then into and through the slotted transition plate. In a second embodiment, a resonating engine is used as a source of hot gases.

13 Claims, 2 Drawing Sheets

DRYER APPARATUS USING HOT GASES IN FREE STANDING VORTEX

This invention relates to improvements in industrial dryers of the type using a free standing vortex for drying purposes and, more particularly, to a dryer which generates a free standing vortex with the use of an improved transmission between straight line hot gases and a free standing vortex condition.

BACKGROUND OF THE INVENTION

Industrial dryers of conventional construction have often used a free standing vortex containing hot gases swirling around in a vortex mode in an open space. Drying of wet materials directed into the path of travel of hot gases flowing through the space causes the liquid content of the materials to be separated and evaporated from the solid content of the materials directed into the path of the hot gases. The vortex seems to work on the principal of centrifugal force wherein the liquid content is dripped from the solid content, leaving the solid content in the vicinity of the vortex while the liquid content and portions of the solid content are removed by evaporation from the space in which the vortex takes place. While the desired aim is the saving of time in drying industrial materials and waste of all types, it is also important that the apparatus for drying materials using a free standing vortex be simple and rugged in construction and have a relatively few number of moving parts yet the dryer provides for the drying of industrial materials in a minimum of time with a high degree of efficiency. The present invention provides such a dryer.

SUMMARY OF THE INVENTION

The present invention is directed to several embodiments of an industrial dryer for drying all types of industrial materials, such as sludge, salt water, brines and the like. The apparatus of the present invention is provided with relatively few moving parts and its structure is simple and of substantially minimal complexity.

The several embodiments of the apparatus of the present invention all rely upon an improved transition plate which is slotted in a manner to cause hot gases flowing toward and through the slots to be immediately transformed into a free standing vortex on the downstream side of the transition plate. The vortex itself will be formed in a minimum of time and will operate on the wet materials directed into the path or center of the vortex to immediately cause drying. Structure is provided to collect the water vapor created by the drying action.

In a first embodiment of the apparatus, hot gases are created by the operation of a blower which directs air under pressure and increasing velocity through a heater and then into and through the slotted transition plate from whence the free standing vortex is generated in a downstream space.

In a second embodiment, a resonating engine is used as a source of hot gases, such gases moving out of the engine and along a central barrel of the engine and in through the slots of the transition plate. A tube moves the materials into the space in which the free standing vortex is generated. The material being dried absorbs the engine heat by the resonating and mixing of the vortex by the resonating engine, thereby causing instant drying. This step minimizes the drying time required to dry the wet materials directed into the apparatus at a location downstream of the transition plate.

The primary object of the present invention is to provide an improved, industrial dryer using a free standing vortex as the drying means wherein is provided an improved slotted transition plate downstream of a source of hot gases and the hot gases are directed into and through the slots of the plate to a space at the downstream side of the plate in which the free standing vortex is generated and into which the materials to be dried are directed for immediate drying.

Another object of the present invention is to provide a method of drying industrial materials which provides that hot gases move through a slotted transition region to form a free standing vortex following which the materials to be dried are moved into the free standing vortex to thereby create the drying action immediately to thereby minimize drying time yet assure that the drying is done efficiently and in a confined space.

Other objects of the present invention will become apparent as the following specification progresses, reference being had to the accompanying drawings for an illustration of the invention.

DETAILED DESCRIPTION OF THE PREFERRED EMBODIMENT

Figures 1, 2:
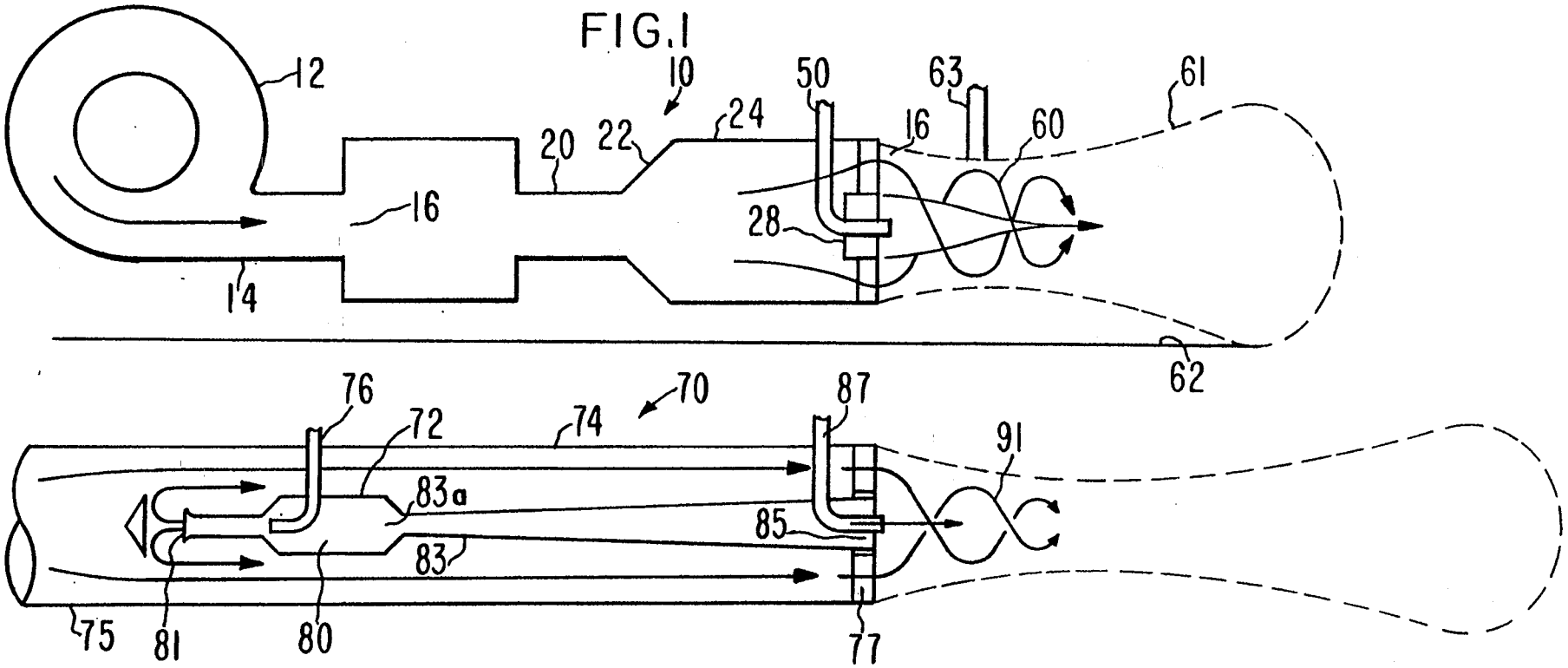
FIG. 1 is a schematic side elevational view of a free standing vortex generator forming a first embodiment of the present invention.
FIG. 2 is a view similar to FIG. 1 but showing a second embodiment of a free standing vortex generator, the generator using a resonating engine.

A first embodiment of the materials dryer of the present invention is broadly denoted by the numeral 10 and includes a blower 12 of conventional construction, the outlet 14 of the blower 12 being coupled to the inlet 16 of a heater 18 which heats the air from blower 12 before it flows through a pipe 20 to the inlet 22 of a tubular member 24 whose outlet 26 has a slotted member 28 extending across the path of the air. The air flow through slotted member 28 causes a free standing vortex to be generated for drying wet materials.

Figure 4:
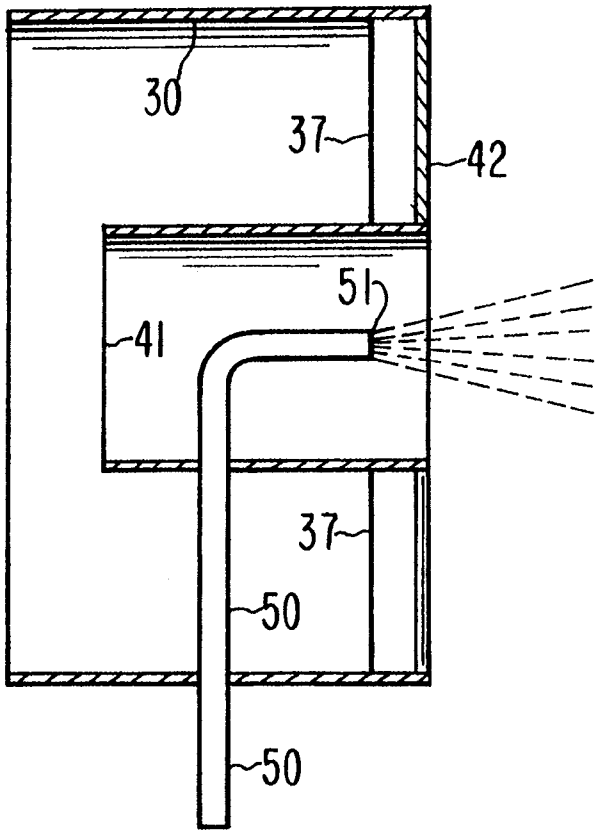
FIG. 4 is a cross-sectional view taken along line 4—4 of FIG. 3.
Figure 5:
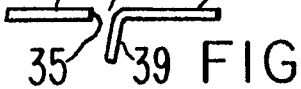
FIG. 5 is a cross-sectional view taken along line 5—5 of FIG. 3.
Figure 6:
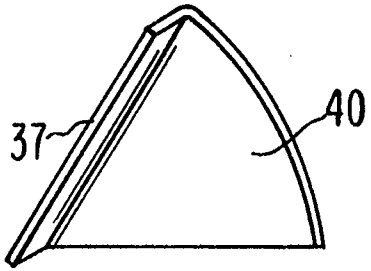
FIG. 6 is a perspective view of a segment of the member of FIGS. 3 and 4.
Figure 3:
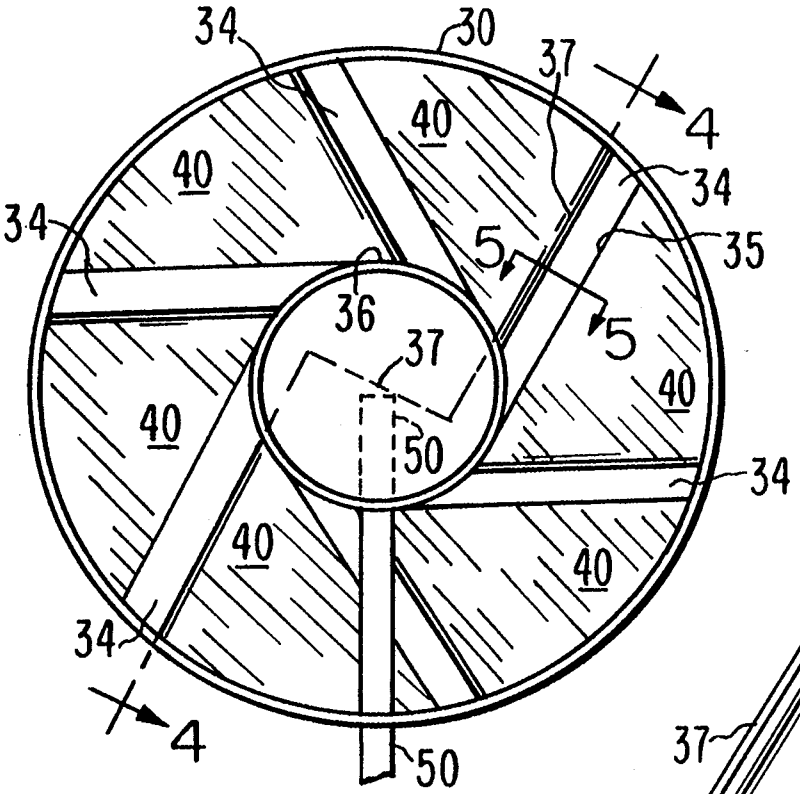
FIG. 3 is a rear elevational view of a disk-like member having slots therethrough for causing the generation of a free standing vortex.

Member 28 is shown in detail in FIGS. 4–6. The member includes an outer, annular flange 30 mounted on the annular outer periphery of a disk-like member 32 having slots 34 therein which are non-radial. Each slot 34 has a certain width and extends outwardly from one end of a cylindrical segment 38 to flange 30. Member 38 is secured to wall segments 40 which define a front wall 42 (FIG. 4) of member 30.

There are six slots 34 in member 32. Each slot 34 is generally parallel to an imaginary radial line passing through the central axis 37 of member 38 and flange 30. The outer peripheral edge of each segment 40 is secured to flange 30. Each slot 34 is formed by a sharp edge 35 and a turned down edge 39 in which the portion of the disk that was cut to form the slot 34 is bent down and extends inwardly from front wall 42 (FIG. 5).

The liquid materials to be dried by dryer 10 are directed into the interior of member 30 by pipe 50 whose outlet end is in the vicinity of the front, open end of cylinder 38 which is closed at the rear end thereof by a disk-like element 41. By placing the outlet end of pipe 50 as shown in FIG. 4, the wet materials to be dried are forced directly into the free standing vortex.

In operation, dryer 10 is put into use by energizing blower 12 which causes air under pressure to be directed through air heater 18 and then through tube 20 to the expanding space 24 from whence the hot air passes through the slots 34 of plate 28 and forms a free standing vortex 60. Liquid materials are directed through tube 50 into the vortex.

The presence of slots 34 causes the generation of the free standing vortex 60 in the free space whose outer boundary is identified by the envelope 61. This vortex causes the drying of the wet materials sent into the vortex, directly downstream of the slots 34. The drying effect is done almost instantaneously and the materials which are drying gravitate to a bottom surface 62 where the materials are collected and re-used as deemed necessary. Water vapor from the drying is directed upwardly through a stack 63.

In a second embodiment of the apparatus of the present invention, a dryer 70 includes a resonating engine 72 placed within a barrel 74 having an upstream end 75 by which a flow of hot air is directed toward and through the downstream, slotted member 77 (FIG. 2) at the downstream end of barrel 74. The passage of hot gases through slotted member 77 causes a free standing vortex 91 to be generated.

Resonating engine 70 can be conventional in construction. Typical resonating engines are disclosed in U.S. Pat. Nos. 2,462,955 and 3,798,786.

Engine 72 includes a combustion chamber 80 having an inlet 81 for air and a fluid fuel inlet tube 76 by which is formed a mixture of fuel and air which is combustible and which is ignitable in any suitable manner, such as by spark plug 79.

A conical tube 83 leads from the outlet 83*a* of resonating engine 70 to the central open space 85 of a slotted member 77. Member 77 has the same construction and the same characteristics as member 16 of FIG. 1.

Also, liquid materials to be dried are directed into the vortex 91 downstream of the central portion 85 of member 77 by a tube 87.

In operation, the resonating engine is put into use by igniting the fuel/air mixture in chamber 80. When so fired, the combustion gases from the resonating engine accelerate forwardly through conical tube 83 and then through the slots 34 of member 77 which is substantially the same as member 16 of FIG. 1 except that member 77 has no inner end wall 41 as shown in FIG. 4.

As soon as the hot gases flow through the slots 34 of member 77, a free standing vortex 91 is formed in the region downstream of member 77. Also, when liquid materials are directed into the vortex, the materials are quickly dried and are free of moisture so that the materials gravitate onto the surface below the vortex generator and the materials can be collected later in a dry condition for further use, for storage or for any other purpose.

I claim:

1. Apparatus for drying materials containing a liquid content and a solid content comprising:

means for creating a flow of hot gases along a predetermined path;

a plate having slot means in a zone across said path, said slot means being configured and operable to cause a free standing vortex of said gases to be created in the space downstream of said plate as said gases flow along said path; and means coupled with the path defining means for directing said liquid content of said materials into said vortex.

2. Apparatus as set forth in claim 1, wherein said source of gases includes a blower, having a fluid outlet, and a heater for heating the air from the outlet of the blower.

3. A method of drying materials including a liquid content and a solids content comprising:

directing a flow of hot gases along a predetermined path toward a slotted transition zone;

directing the hot gases through the slots to change the direction of flow of the gases at said zone to create a free standing vortex of said gases in a space downstream of the zone; and introducing the materials into the gases of said vortex to vaporize the liquid content and to dry the solids content.

4. A method as set forth in claim 3, wherein said changing step includes directing the hot gases through a plurality of slots at the zone to generate said free standing vortex in said space as a function of the movement of the gases through the slots.

5. A method as set forth in claim 3, wherein the step of providing the hot gases includes directing said gases in one direction along said path and heating the gases as they flow along said path.

6. In a hot air dryer, a transition member for forming a free standing vortex, said member having an end face provided with a plurality of slots therethrough, each slot being substantially parallel to an imaginary radial line and being laterally offset from said radial line.

7. In a hot air dryer as set forth in claim 6, wherein is included a flange along one edge of each slot, the flange extending inwardly of the member from said slot and extending substantially the full length of the slot.

8. Apparatus for drying materials containing a liquid content and a solid content comprising:

means for creating a flow of hot gases along a predetermined path;

slot means in a zone across said path for changing the direction and velocity of flow of said gases, said changing means being operable to create a free standing vortex of said gases in the space downstream of said zone; and a pipe extending into the region of the vortex for directing said materials into said vortex.

9. Apparatus for drying materials containing a liquid content and a solid content comprising:

means for creating a flow of hot gases along a predetermined path;

a cylindrical member having a face plate provided with a plurality of slots therethrough, each of said slots being parallel to an imaginary radial line and being radially offset from said radical line, said member being operable to create a free standing vortex of said gases in the space downstream of said zone; and a tube extending into the member downstream of the slots for directing said materials into said vortex.

10. Apparatus for drying materials containing a liquid content and a solid content comprising:

means for creating a flow of hot gases along a predetermined path;

a plate having slot means in a zone across said path, said slot means being configured and operable to cause a free standing vortex of said gases in the space downstream of said plate;

means coupled with the path defining means for directing said liquid content of said materials into said vortex; and said slot means including a cylindrical member having an end face provided with a plurality of slots therethrough, each of said slots being substantially parallel to an imaginary radial line and being laterally offset from said radial line.

11. Apparatus as set forth in claim 10, wherein is included a flange along one edge of each slot, the flange extending inwardly of the member from said slot and extending substantially the full length of the slot.

12. Apparatus as set forth in claim 10, wherein said source of gases includes a resonating engine.

13. A method of drying materials including a liquid content and a solids content comprising:

directing a flow of hot gases along a predetermined path toward a transition zone;

changing the direction of flow of the gases at said zone to create a free standing vortex in a space downstream of the zone; and introducing the materials into the gases in said space to vaporize the liquid content and to dry the solids content, each of said slots being arranged in parallelism with a respective imaginary radial line with the length of the slots being less than the maximum transverse dimension of said space.

* * * * *